US007699122B2

(12) United States Patent
Eriksen

(10) Patent No.: US 7,699,122 B2
(45) Date of Patent: Apr. 20, 2010

(54) DEVICE FOR HANDLING OF PIPES AT A DRILL FLOOR

(76) Inventor: Morten Eriksen, Grannessletta 92, Royneberg (NO) N-4052

( * ) Notice: Subject to any disclaimer, the term of this patent is extended or adjusted under 35 U.S.C. 154(b) by 200 days.

(21) Appl. No.: 11/813,735

(22) PCT Filed: Jan. 9, 2006

(86) PCT No.: PCT/NO2006/000006

§ 371 (c)(1),
(2), (4) Date: Jul. 11, 2007

(87) PCT Pub. No.: WO2006/075914

PCT Pub. Date: Jul. 20, 2006

(65) Prior Publication Data

US 2008/0128167 A1 Jun. 5, 2008

(30) Foreign Application Priority Data

Jan. 12, 2005 (NO) ..... 20050166

(51) Int. Cl.
*E21B 19/00* (2006.01)

(52) U.S. Cl. ..... 175/52; 175/85; 414/22.54; 414/22.58; 414/22.63; 414/22.68; 414/22.71

(58) Field of Classification Search ..... 175/52, 175/85; 414/22.52, 22.54, 22.57, 22.58, 414/22.61, 22.63, 22.68, 22.71
See application file for complete search history.

(56) References Cited

U.S. PATENT DOCUMENTS 4,042,123 A * 8/1977 Sheldon et al. ..... 414/22.71
4,077,525 A 3/1978 Callegari et al.
4,725,179 A 2/1988 Woolslayer et al.
4,765,401 A * 8/1988 Boyadjieff ..... 166/77.53
4,822,230 A 4/1989 Slettedal
5,437,527 A 8/1995 McGill et al.

FOREIGN PATENT DOCUMENTS

EP 0 267 002 A2 5/1988
WO WO 02057593 A1 7/2002

OTHER PUBLICATIONS

International Search Report for parent application PCT/NO2006/000006, having a mailing date of Apr. 20, 2006.

* cited by examiner

*Primary Examiner*—Giovanna C Wright
(74) *Attorney, Agent, or Firm*—Andrus, Sceales, Starke & Sawall, LLP

(57) ABSTRACT

A device for handling and storage of drill string sections, and assembly or disassembly of a drill string on an installation especially intended for exploratory and/or production drilling for hydrocarbons, where: at least one set of individual, separate cooperating means of transport is arranged to move a drill string section or a single drill pipe length in synchronized motion; where a) a primary means of transport is provided with a first gripping device for releasably holding a lower end portion of the drill string section or drill pipe length; b) a secondary means of transport is provided with a first means of lateral support for releasably enclosing an upper end portion of the drill string section or drill pipe length; and c) each means of transport is displaceable along a substantially horizontal or vertical guideway.

23 Claims, 10 Drawing Sheets

DEVICE FOR HANDLING OF PIPES AT A DRILL FLOOR

CROSS-REFERENCE TO RELATED APPLICATIONS

This application is the U.S. national stage application of International Application PCT/NO2006/000006, filed Jan. 9, 2006, which International Application was published on Jul. 20, 2006, as International Publication No. WO 2006/075914 A1 in the English language. The International Application claims priority of Norwegian Patent Application 20050166, filed Jan. 12, 2005.

BACKGROUND AND SUMMARY

The invention regards a device for a system for handling of pipes, especially drill pipes, at a drill floor on an installation for exploration and production drilling, substantially for hydrocarbons, more particularly a system for storage of drill string sections, preferably in a vertical position, and transport of these between the storage location and an upper and a lower pipe handler located in close proximity to the extension of the wellbore axis of a drill floor for joining to the drill string, or between the storage location and means of separating the drill pipe lengths of the drill string sections and placing these, preferably in a horizontal position, in intermediate storage or a transit rack, or retrieval of drill pipe lengths from the transit rack, moving these, preferably to a vertical position, and joining these to form an assembled drill string section.

In its most advanced form, prior art in this area comprises one or more manipulators positioned upright or moving at the drill floor, and which are provided with one or more devices arranged to grip a drill string section and move it between a storage area, in the form of e.g. a finger board, and the drill string protruding up through the drill floor, where the drill string is being assembled or disassembled. Known drill string manipulators or handlers take up a lot of space at the drill floor, an area where a large accessible storage space is required for various components, tools etc. Moreover, known drill string handlers are heavy, which is a disadvantage in terms of the dimensioning of constructional supports etc., and also when considering the loading capacity that is available for operating equipment such as mud, cement, liners, drill pipes etc. onboard floating installations. In the case of older installations, the space may be so limited as to make it physically impossible for a known drill string handler to operate due to e.g. surrounding and overlying derrick structures etc.

The object of the invention is to remedy or reduce at least one of the disadvantages of prior art.

The object is achieved by the characteristics given in the description below and in the following claims.

The invention regards a device for a system for handling and storage of drill string sections and assembly or disassembly of a drill string on an installation intended especially for exploration and/or production drilling for hydrocarbons, at least one set of individual, separate cooperating means of transport being arranged to move a drill string section or a single drill pipe length by synchronized movement, where a) a primary means of transport is provided with a first gripping device for releasably holding a lower end portion of the drill string section or the drill pipe length;

b) a secondary means of transport is provided with a first means of lateral support for releasably enclosing an upper end portion of the drill string section or the drill pipe length; and where c) each means of transport can be displaced along an essentially horizontal or vertical guideway.

Advantageously at least one primary means of transport is provided with means of joining and separating drill pipe lengths in the drill string section; and advantageously at least one primary means of transport is provided with means of vertical displacement of the first gripping device.

Preferably the device comprises an upper and a lower finger board for positioning of the upright drill string section in a storage area and holding the drill string section in a chosen storage position, where the upper and lower finger boards are each provided with at least one set of transport means for substantially horizontal displacement of the drill string section along the guideways; together with means positioned in close proximity to the upper and lower finger boards, respectively, for joining and separating the drill section to/from the drill string.

Preferably the device comprises:

a) means of moving a drill pipe length between a horizontal position and a vertical position;

b) means of joining and separating at least two upright drill pipe lengths associated with an upright drill string section by rotating a drill pipe length about its central axis for joining or separation at the thread areas of the drill pipe length;

c) a lower pipe handler and an upper pipe handler located in close proximity to the extension of the wellbore axis of a drill floor; and d) means of transferring a drill pipe length or a drill string section between a) and b), between b) and the finger boards, between the finger boards and c), and also between b) and c).

Preferably the device comprises means of moving a drill pipe length between a horizontal position and a vertical position, where the means comprise a first gripping device mounted on a first primary means of transport arranged to move along a first guideway, and a first means of lateral support mounted on a first secondary means of transport arranged to move along a second guideway.

Preferably the first guideway is essentially horizontal.

Preferably the second guideway is essentially vertical.

Preferably a third guideway comprises at least two vertically displaceable means of transport, each provided with gripping devices and/or means of lateral support for rotational joining and separation of the thread areas of the drill string sections and vertical displacement of the assembled drill string section or the separate drill pipe length; means of moving the upright drill pipe length out of engagement with the first gripping device and the first means of lateral support and into engagement with the gripping device and/or means of lateral support of the third guideway; and also means of moving the upright drill string section into or out of engagement with the upper and lower pipe handlers.

Preferably the third guideway comprises an upper second secondary means of transport provided with a second means of lateral support for releasably enclosing an upper end portion of the drill string section or a first drill pipe length; furthermore an intermediate second primary means of transport provided with a second gripping device for releasably holding a middle section of the drill string section or a lower end portion of the first or a second drill pipe length; furthermore a lower tertiary means of transport provided with a clamping device for releasably holding a lower part of the drill string section or the lower end portion of a drill pipe length; the intermediate second primary means of transport and/or the lower tertiary means of transport being provided with means of rotating the drill string section or parts thereof about the central axis of the pipe.

Preferably the means of moving the drill string section into or out of engagement with the lower and upper pipe handlers comprise a fourth and a fifth guideway, respectively, a third primary means of transport provided with a third gripping device for releasably holding the lower end portion of the drill string section being movably coupled to the fourth guideway, and a third secondary means of transport provided with a third means of lateral support for releasably enclosing the upper end portion of the drill string section being movably coupled to the fifth guideway.

Preferably the device comprises means of transport for horizontal displacement of a drill string section along a sixth and a seventh guideway, respectively, in close proximity to the free finger ends of the upper and lower finger boards, respectively; and means of transport for horizontal displacement of a drill string section along the fingers of the upper and lower finger boards.

Preferably the means of transport for horizontal displacement of a drill string section along the sixth and seventh guideway, respectively, comprise a fourth secondary means of transport with a fourth means of lateral support for releasably enclosing en upper end portion of a drill string section, and a fourth means of transport with a fourth gripping device for releasably holding the lower end portion of the drill string section, respectively.

Preferably the means of transport for horizontal displacement of the drill string section along the fingers of the upper and lower fingerboards, respectively, comprise a fifth secondary means of transport with a fifth means of lateral support for releasably enclosing the upper end portion of the drill string section, and a fifth primary means of transport with a fifth gripping device for releasably holding the lower end portion of the drill string section, respectively.

Preferably the fifth primary means of transport and the fifth secondary means of transport, respectively, are each provided with separate coupling means for releasable coupling to a shuttle carriage.

Preferably the shuttle carriage is arranged, after controlled release of the fifth secondary means of transport and the fifth primary means of transport, respectively, from movable interconnection with an arbitrary finger on the upper and lower finger board, respectively, to bring a fifth secondary means of transport and the fifth primary means of transport, respectively, into engagement with another arbitrary finger in the upper and lower finger board, respectively.

Preferably the means of transport is provided with or connected to means of controlling the carriage travel.

Preferably the device comprises means of monitoring the position of any drill string section in the system.

Preferably one or more of the clamping means, the lower pipe handler and the gripping devices are provided with lifting means for vertical movement of the drill string section or the drill pipe length.

Preferably one or more of the clamping means, the lower and the upper pipe handlers, the gripping devices and the means of lateral support are provided with means of effecting horizontal movement of the drill string section or the drill pipe length.

Preferably at least one of the gripping devices is provided with means of providing fixed vertical support for the drill string section.

Preferably each finger of the upper finger board comprises means of holding a single drill string section or a group of drill string sections.

Preferably the lower pipe handler is provided with means of effecting horizontal and vertical displacement of an upper and a lower pipe gripping tong.

Preferably the lower pipe gripping tong is arranged to hold the drill string in a firm grasp and the upper pipe gripping tong is arranged to rotate the drill string section about the central axis of the pipe for joining the drill string section to or separating it from the drill string.

Preferably the means of transport are carriages that engage the driving means of the guideway or the shuttle carriage.

Alternatively the means of transport are fixed to a belt or chain-like device extending along a substantial portion of the longitudinal extent of the guideway.

BRIEF DESCRIPTION OF THE DRAWINGS

The following describes a non-limiting example of a preferred embodiment illustrated in the accompanying drawings, in which.

DETAILED DESCRIPTION OF THE DRAWINGS

Figure 1:
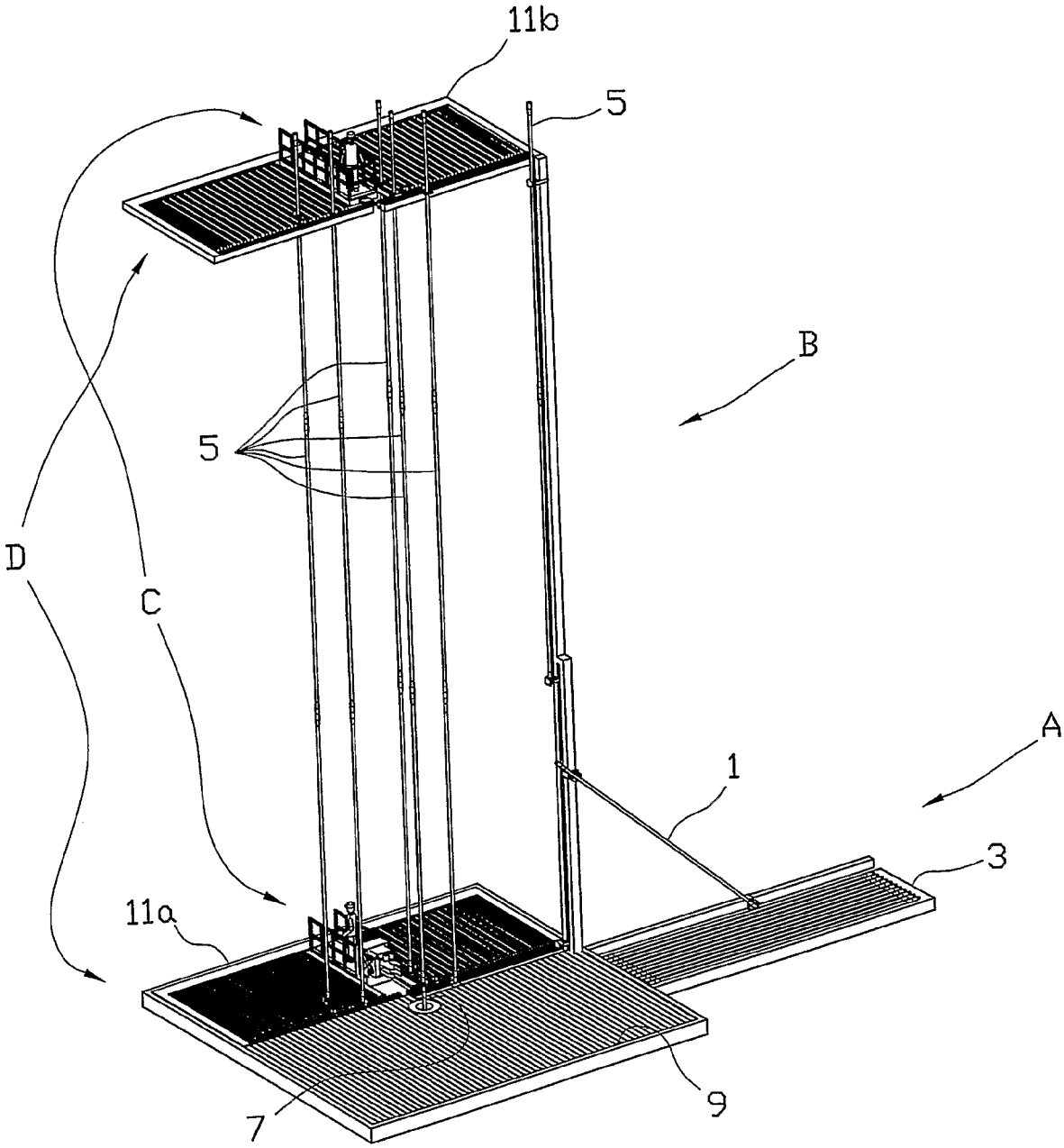
FIG. 1 is a perspective view of a system for drill string handling according to the invention.

A system of the invention, such as shown in FIG. 1, is installed at the drill floor 9 of a drilling installation, with parts of the system supported or stabilized by the installation drilling derrick (not shown) or other upwardly projecting constructional supports. The letter A refers to a subsystem (subsystem A) for raising of drill pipe lengths 1 from a horizontal position in a transit rack 3 to a vertical position for assembly of drill pipe lengths 1 to form drill string sections 5, or optionally for laying the drill pipe lengths 1 down in a horizontal position in the transit rack 3 following the dismantling of the drill string section 5.

The letter B refers to a subsystem (subsystem B) for successive assembly of three drill pipe lengths 1 to form a drill string section 5 in a vertical position, or optionally for disassembly of a drill string section 5 into individual drill pipe lengths 1.

The letter C refers to a subsystem (subsystem C) for joining/dismantling of a drill string section 5 with/from a drill string 7 protruding up through a drill floor 9.

The letter D refers to a subsystem (subsystem D) for transport of drill string sections 5 between subsystem B, subsystem C and lower and upper finger boards 11*a*, 11*b* for storage of drill string sections 5 in a vertical position at the drill floor 9.

Figure 2:
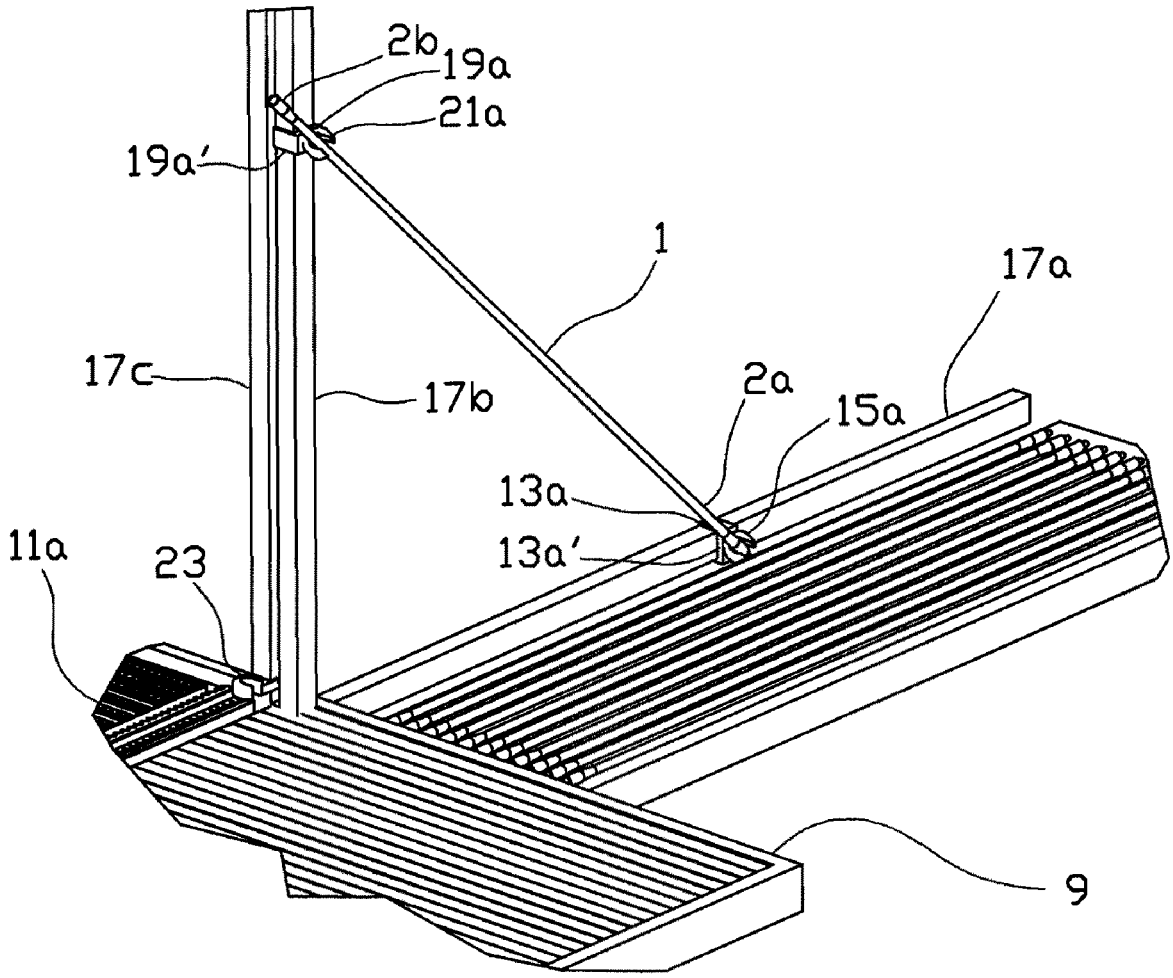
FIG. 2 is a view of subsystem A for handling of drill pipe lengths between a horizontal and a vertical position, on a slightly larger scale.

Referring to FIG. 2, reference number 13*a* denotes a first primary carriage provided with a first gripping device 15*a* arranged to releasably hold a lower end portion 2*a* of a drill pipe length 1. The first primary carriage 13*a* is connected to a substantially horizontal first guideway 17*a*, and the primary carriage 13*a* can be displaced along the first guideway 17*a*. A first secondary carriage 19*a* is provided with a first means of lateral support 21*a* arranged to releasably enclose an upper end portion 2*b* of the drill pipe length 1. The first secondary carriage 19*a* is connected to a substantially vertical second guideway 17*b*, and the secondary carriage 19*a* can be displaced along the second guideway 17*b* in synchronized motion with the travel of the first primary carriage 13*a* along the first guideway 17*a*. The term "synchronized motion" as used herein, means that the secondary carriage moves in a controlled fashion relative to the primary carriage, be it at the same or at a different speed, at the same or at a different time.

Reference numbers 2*a* and 2*b* also refer to the lower and upper end portions formed by respective end portions of drill pipe lengths 1 in a drill string section 5 made up of several drill pipe lengths 1.

Figure 3:
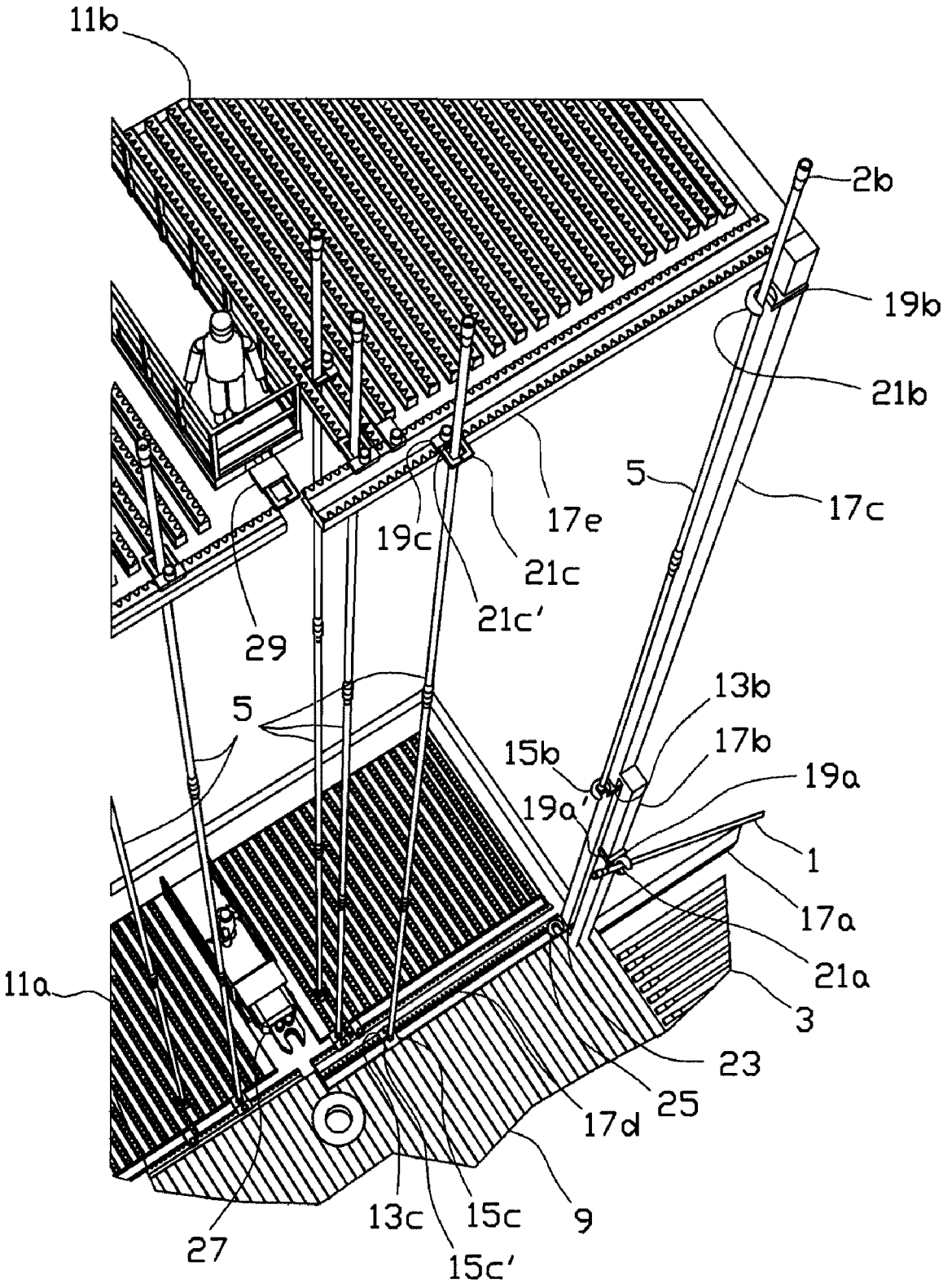
FIG. 3 shows subsystem B for assembly and disassembly of drill string section, and also removal of the drill section to subsystem C.

In FIG. 3, reference number 23 denotes a tertiary carriage provided with a clamping means 25 arranged to releasably hold a lower end portion 2*a* of a drill pipe length 1, either coupled with other drill pipe lengths 1 to form a drill string section 5 or as a separate unit. The tertiary carriage 23 is also provided with means (not shown) of vertically displacing the secured drill pipe length 1/drill string section 5, preferably by vertical movement of the clamping means 25 relative to the tertiary carriage 23. An intermediate second primary carriage 13*b* is provided with a second gripping device 15*b* arranged to releasably hold the lower end portion 2*a* of a drill pipe length 1, either coupled with other drill pipe lengths 1 to form a drill string section 5, or as a separate unit. The second gripping device 15*b* also comprises means (not shown) of rotating the drill pipe length 1/drill string section 5 about the central axis of the pipe 1/section 5. An upper second secondary carriage 19*b* is provided with a second means of lateral support 21*b* arranged to releasably enclose an upper end portion 2*b* of the drill pipe length 1, whether the drill pipe length 1 is the top part of a drill string section 5 or forms a separate unit in connection with assembly or disassembly of a drill string section 5.

The tertiary carriage 23, the second primary carriage 13*b* and the second secondary carriage 19*b* are connected to a substantially vertical third guideway 17*c*, and the carriages 23, 13*b* and 19*b* can be displaced along the guideway 17*c* independently of each other or in a synchronized fashion.

A third primary carriage 13*c* is provided with a third gripping device 15*c* arranged to releasably hold the lower end portion 2*a* of a drill pipe length 1 coupled to a second drill pipe length 1 in a drill string section 5. A third secondary carriage 19*c* is provided with a third means of lateral support 21*c* arranged to releasably enclose the upper end portion 2*b* of the upper drill pipe length 1 of the drill string section 5.

The gripping device 15*a* of the first primary carriage 13*a* and the lateral support means 21*a* of the first secondary carriage 19*a* are provided with means 13*a*', 19*a*' of effecting substantially horizontal controlled movement of the upright drill pipe length 1 between a vertical position at the second guideway 17*b* and the third guideway 17*c*, alternating between holding/lateral support by means of the first gripping device l5*a*/first means of lateral support 21*a* and the second gripping device 15*b*/the clamping means 25.

The second primary carriage 13*b*, the second secondary carriage 19*b* and the tertiary carriage 23 are arranged for synchronized or individual vertical motion along the third guideway 17*c* for vertical movement of a drill pipe length 1 or a fully or partially assembled drill string section 5, or for changing the gripping/lateral support position along the drill pipe length 1/drill string section 5.

The third primary carriage 13*c* and the third secondary carriage 19*b*, respectively, are connected to a substantially horizontal fourth guideway 17*d* and fifth guideway 17*e*, respectively, and the carriages 13*c* and 19*c* can be displaced along guideways 17*d* and 17*e*, respectively. The fourth and fifth guideways 17*d*, 17*e*, respectively, are in all essentials disposed horizontally and parallel to each other, with a mutual spacing slightly smaller than the length of a known drill string section 5. The fourth and fifth guideways 17*d*, 17*e*, respectively, extend between the lower and upper portions, respectively, of the third guideway 17*c* and lower and upper pipe handlers 27, 29, respectively, placed in close proximity to the central axis of the drill string 7.

The gripping device 15*c* of the third primary carriage 13*c* and the lateral support means 21*c* of the third secondary carriage 19*c* are provided with means 15*c*', 21*c*' of effecting substantially horizontal controlled movement of the upright drill string section 5 between a vertical position at the third guideway 17*c* and at the fourth and fifth guideways 17*d*, 17*e*, alternating between holding/lateral support by means of the second gripping device 15*b*/the clamping means 25/the second means of lateral support 21*b* and the third gripping device 15*c*/the third means of lateral support 21*c*.

Figure 5:
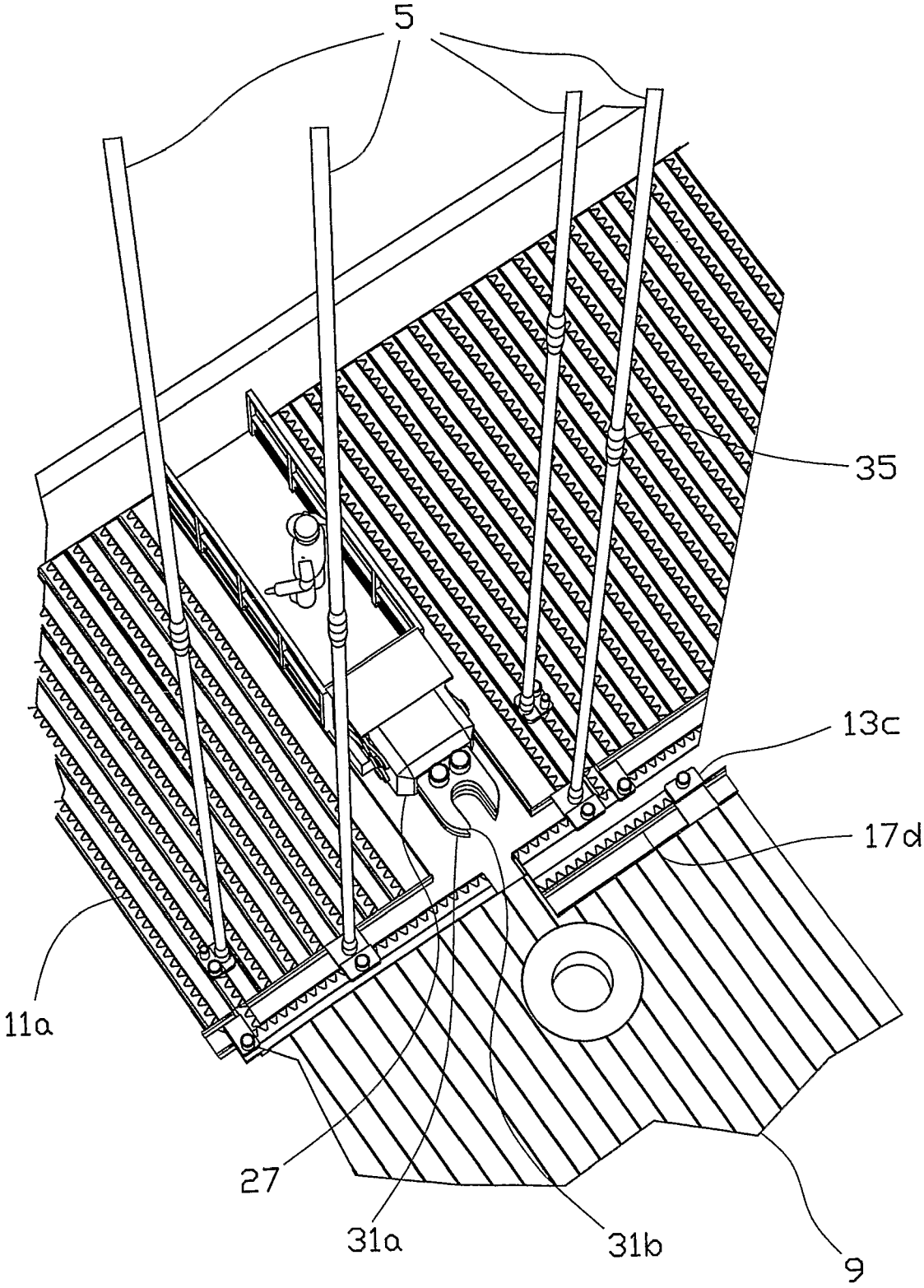
FIG. 5 shows a section of the lower part of subsystem C and subsystem D, on a larger scale.
Figure 6:
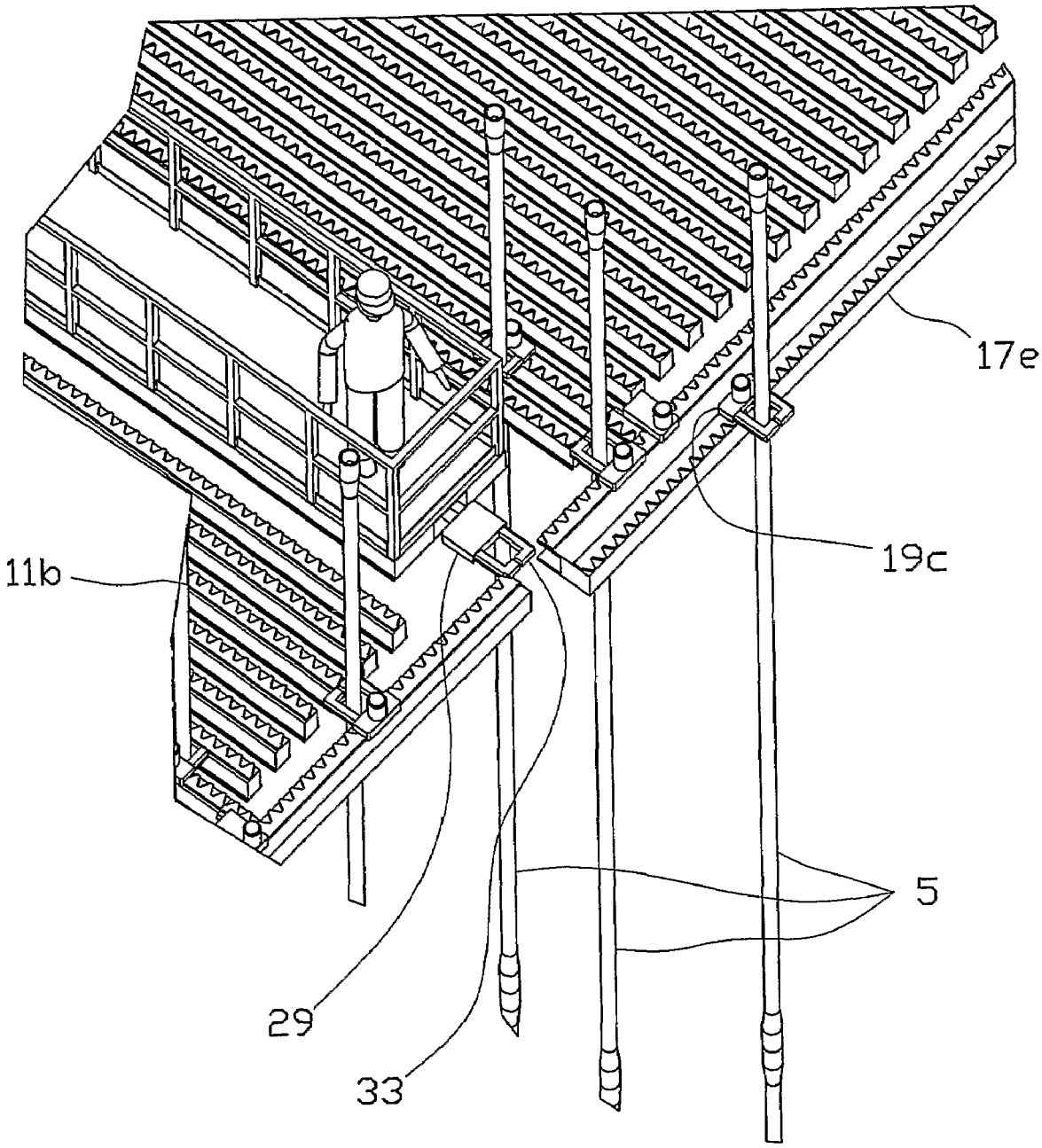
FIG. 6 shows a section of the upper part of subsystem C and subsystem D.

Referring essentially to FIGS. 5 and 6, the lower and upper pipe handlers 27, 29, respectively, are placed centrally on/above the drill floor 9 in close proximity to the central axis of the drill string 7, preferably centrally in the lower and upper finger boards 11*a*, 11*b*, respectively. Both handlers 27, 29 can be displaced horizontally along an axis running through the central axis of the drill string 7.

The lower and upper gripping tongs 31*a*, 31*b* of the lower pipe handler 27 are arranged in a known manner to grip the drill string at a suitable joint, advantageously illustrated by reference number 35 on a randomly chosen drill string section 5, allowing the drill string section 5 located above said joint 35 to be rotated by suitable means (not shown) in the upper gripping tong 31*b*, while the drill string 7 below is kept stationary by the grip of the lower gripping tong 31*a*. The upper gripping tong 31*b* can be closed, opened and rotated independently of the closing and opening of the lower gripping tong 31*a*, thereby extending or shortening the drill string 7 in a manner that is known per se. The upper gripping tong 31*b* is also arranged to move vertically relative to the lower gripping tong 31*a* in order to lower/raise a drill string section 5 relative to the drill string 7 during assembly/disassembly.

The gripping tong 33 of the upper pipe handler 29 is arranged in a known manner to enclose an upper portion of the drill string 5.

The gripping tongs 31*a*, 31*b*, 33 of the lower and upper pipe handlers 27, 29 are arranged for controlled rotation about a vertical axis in the direction of the adjacent guideways 17*d*, 17*e* etc., respectively, in order to receive/hand over the drill string section from/to the primary and secondary carriages 13*c*, 19*c* etc. of the respective guideways 17*d*, 17*e* etc.

Figure 4:
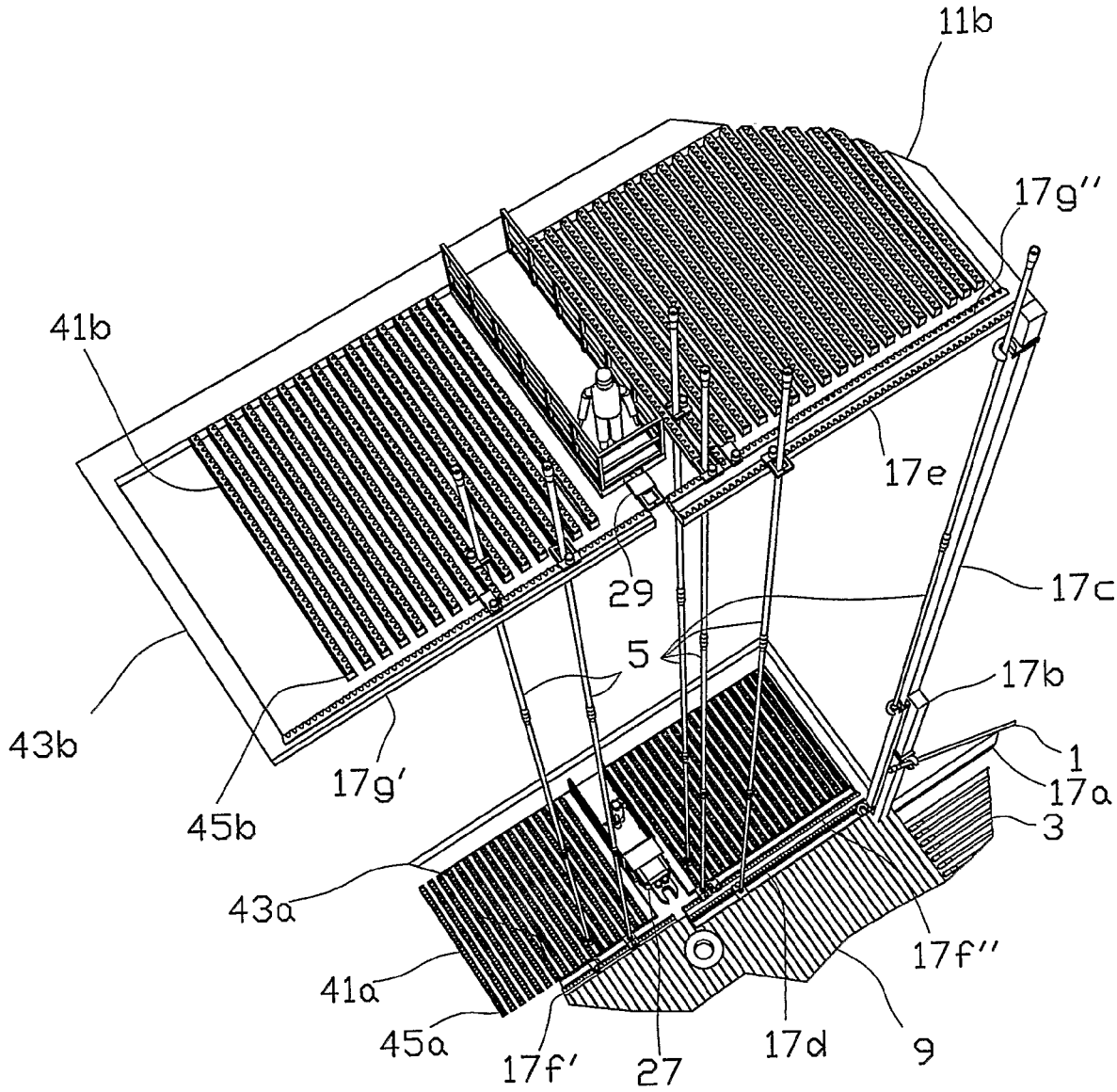
FIG. 4 shows subsystems B, C and a substantial portion of subsystem D, on a smaller scale.
Figure 7:
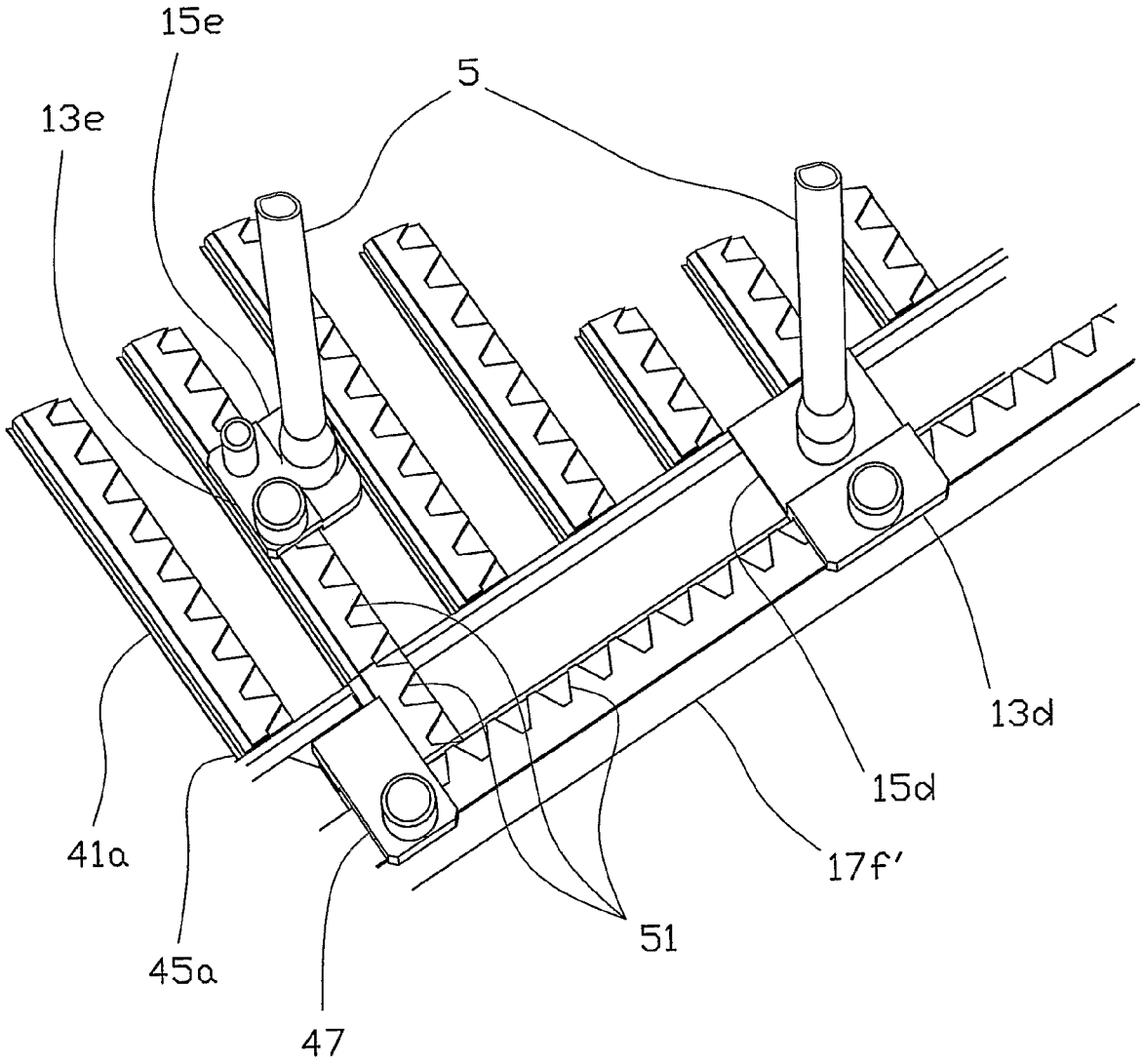
FIG. 7 shows a section of the lower part of subsystem D, on a larger scale.
Figure 8:
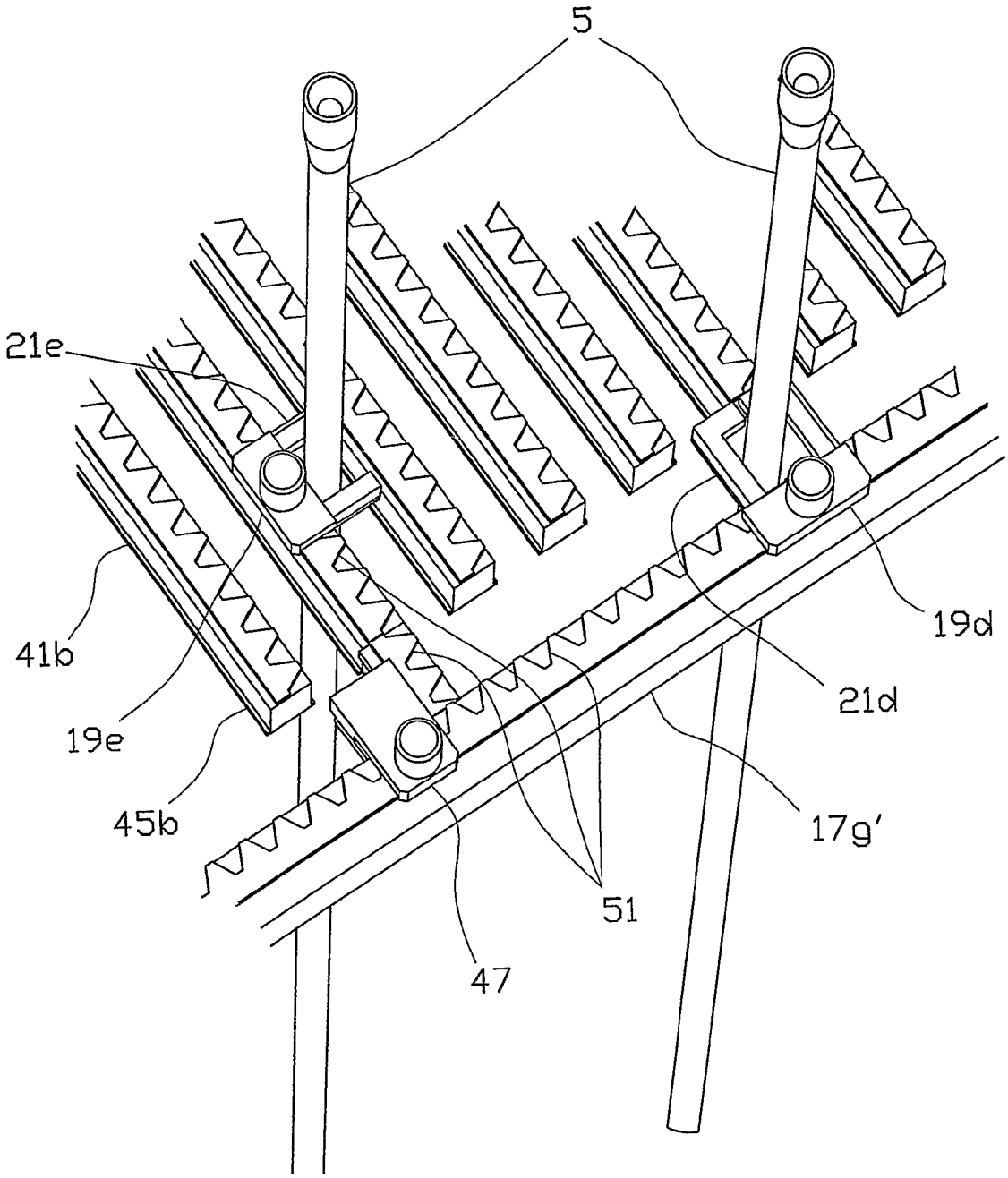
FIG. 8 shows a section of the upper part of subsystem D.

Referring mainly to FIGS. 4, 7 and 8, in which the lower and upper finger boards 11*a*, 11*b*, respectively, are provided with a series of parallel, in all essentials horizontally arranged fingers 41*a* and 41*b*, respectively, fixed at one end to a frame 43*a*, 43*b*. Close by the free ends 45*a*, 45*b* of the fingers 41*a*, 41*b*, across the longitudinal direction of the fingers 41*a*, 41*b* and along the entire extent of the finger boards 11*a*, 11*b*, there is a sixth and a seventh guideway, respectively, each divided into two sections 17*f*', 17*f*" and 17*g*', 17*g*", respectively, by the guideways 17*f*, 17*g* being interrupted at the operating area of the pipe handlers 27, 29.

On each guideway 17*f*', 17*f*" and 17*g*', 17*g*", respectively, there is provided a fourth primary carriage 13*d* and a fourth secondary carriage 19*d*, respectively. On each said guideway 17*f*', 17*f*", 17*g*', 17*g*" there is also a shuttle carriage 47, so that the fourth primary carriage 13*d* and the fourth secondary carriage 19*d*, respectively, are positioned between the shuttle carriage 47 and the operating area of the pipe handlers 27, 29.

Each finger board 11*a* and 11*b*, respectively, is provided with two fifth primary carriages 13*e* and two fifth secondary carriages 19*e*, respectively, with one carriage positioned on either side of the pipe handler.

The fifth primary carriage 13*e* is provided with a fifth gripping device 15*e* arranged to releasably hold the lower end portion 2*a* of a drill string section 5. The fifth primary carriage 13*e* is also provided with means (not shown) of effecting vertical displacement of the drill string section 5 between a position in which the drill string section 5 is supported by the primary carriage 13*e*, and a position in which the drill string section 5 has been released from the fifth primary carriage 13*a* and rests on a deck (not shown) immediately below the lower finger board 11*a*. The fifth secondary carriage 19*e* is provided with a fifth means of lateral support 21*e* arranged to releasably enclose the upper end portion 2*b* of the drill string section 5.

The fifth primary carriage 13*e* and the fifth secondary carriage 19*e*, respectively, are connected to an arbitrary finger 41*a*, 41*b*, respectively, and the carriages 13*e* and 19*e* can be moved in a controlled, preferably synchronous fashion along the fingers 41*a* and 41*b*, respectively.

All carriages 13*a-e*, 19*a-e*, 23 are provided with driving means (not shown) that mesh with teeth 51 on one of the surfaces of the guideways 17*a-g*" and the fingers 41*a*, 41*b*, respectively.

The shuttle carriage 47 is provided with a coupling section 53 arranged to connect an arbitrary finger 41*a*, 41*b* with the guideway 17*f*', 17*f*", 17*g*', 17*g*". The coupling section comprises toothing 51' that corresponds with the toothing 51 on the finger 41*a*, 41*b* and the guideway 17*f*', 17*f*", 17*g*', 17*g*".

The shuttle carriage 47 is provided with means (not shown) for connecting to the fifth primary carriage 13*e* and the fifth secondary carriage 19*e*, respectively.

Preferably the device of the invention comprises means (not shown) of controlling the positions and movements of the carriages 13*a-e*, 19*a-e*, 23 along the guideways 17*a-g*" and fingers 41*a-b*, the vertical and horizontal movements of the drill pipe lengths 1 and the drill string sections 5 effected by the carriages 13*a-e*, 19*a-e*, 23 and the pipe handlers 27, 29, and the holding of the drill pipe lengths 1 and the drill string sections 5 in the carriages 13*a-e*, 19*a-e*, 23 and the pipe handlers 27.

Figure 9:
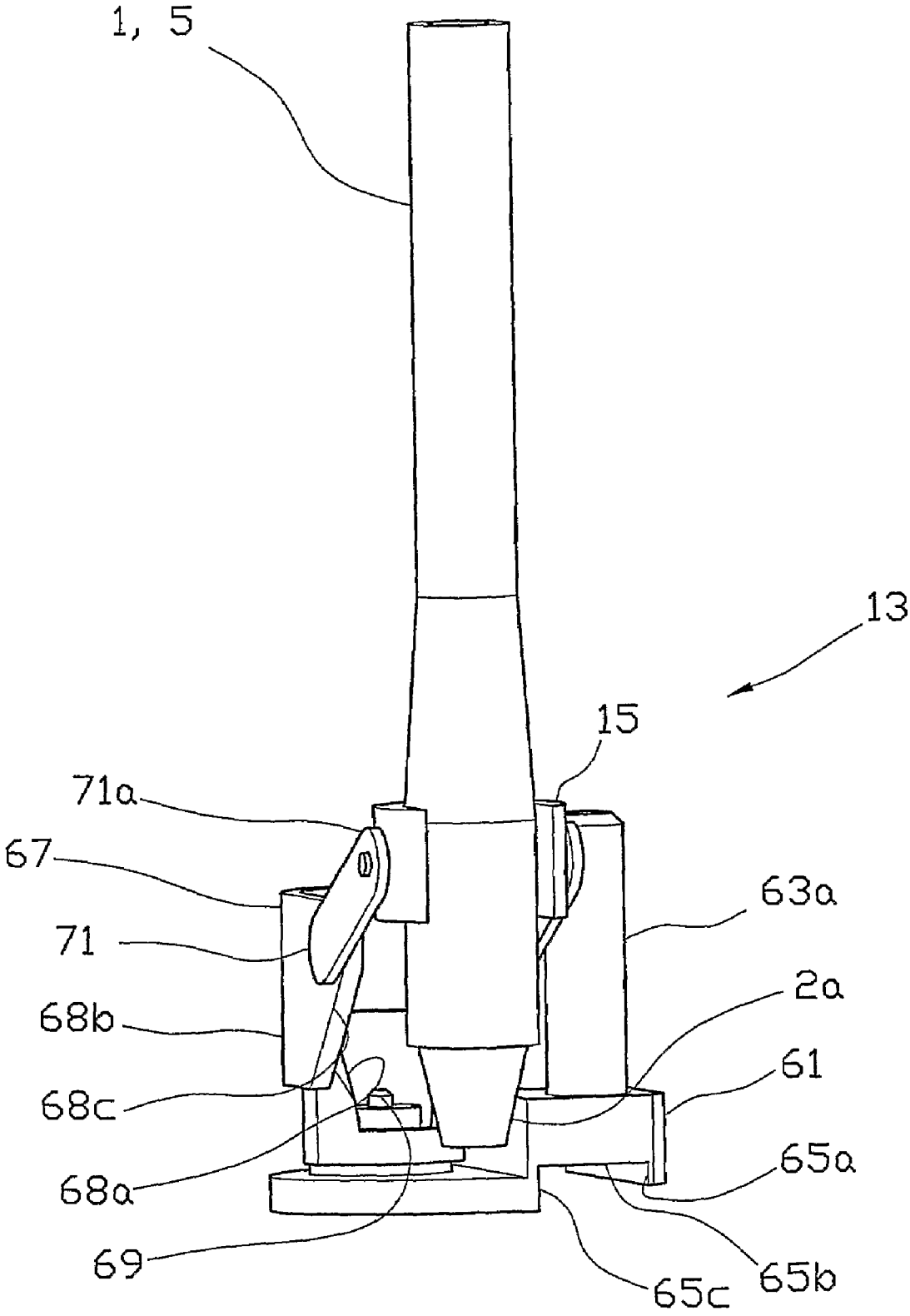
FIG. 9 shows an embodiment of a primary carriage having a gripping device for holding and moving a drill pipe or a drill string section horizontally and vertically, on a larger scale and shown here with the drill pipe swung out from the primary carriage.
Figure 10:
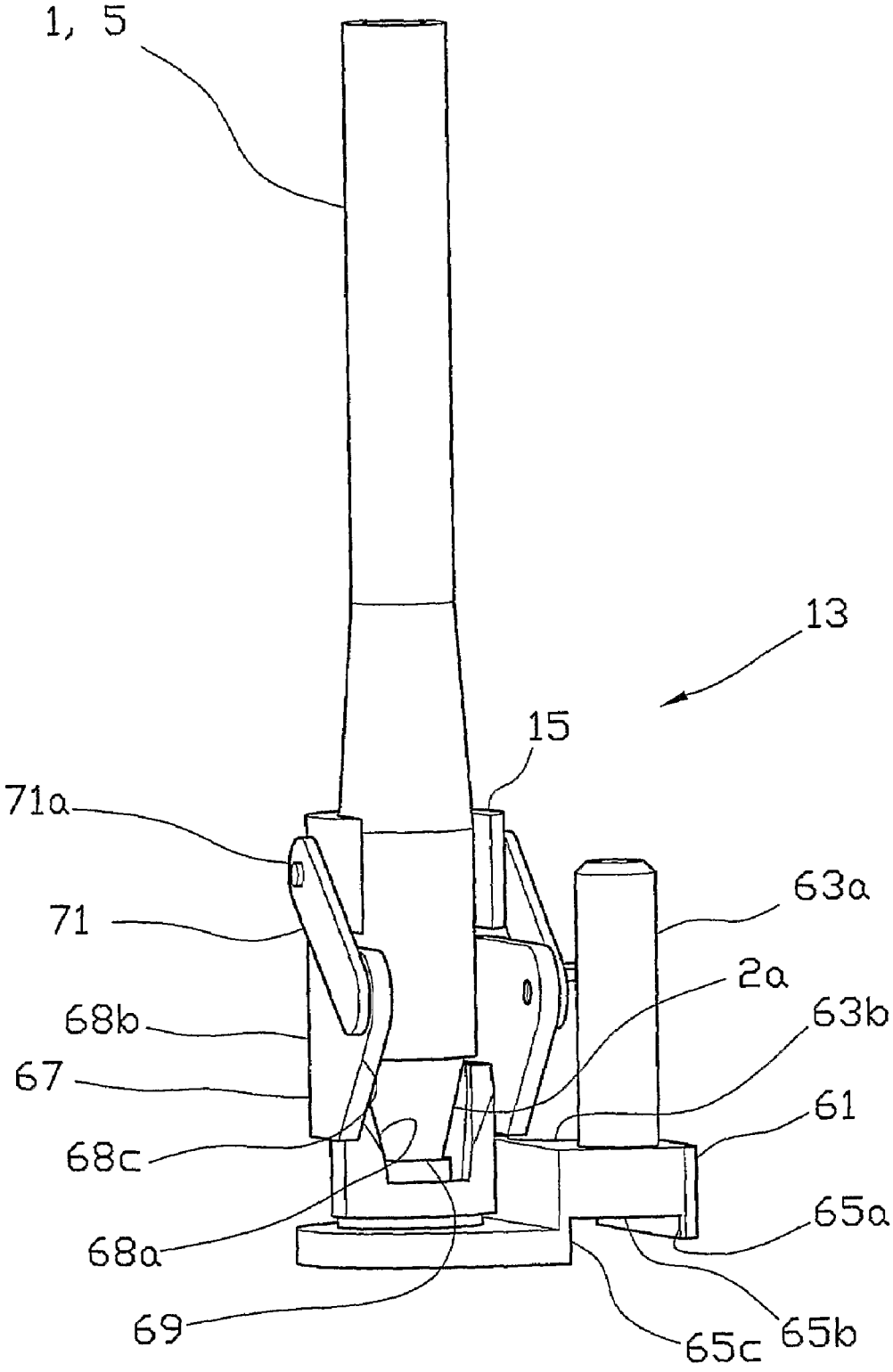
FIG. 10 shows the primary carriage, on the same scale, with the drill pipe resting on the carriage.

Referring to FIGS. 9 and 10, a primary carriage 13 is provided with an underbody 61 having a driving motor 63 and contact faces 65*a-c* suited for enclosing parts of the cross section of a guideway 17*a*-17*g*" or a finger 41*a-b* and engaging the teeth 51 on one of the surfaces of the guideways 17*a*-17*g*" or fingers 41-*b*. A foot 67 having a middle section 68*a* partially enclosed by a sidewall 68*b* is rotatably attached to a projecting portion of the of the underbody 61, the axis of rotation of the foot 67 being essentially perpendicular to the projecting portion of the underbody. The rotation of the foot 67 is controlled by an actuator (not shown). A locating peg 69 projects into the middle section 68*a* and is capable of receiving the lower end portion 2*a* of the drill string 5 or the drill pipe length 1 in a laterally supporting fashion.

Two link arms 71 are rotatably attached to the projecting upper parts 68*c* of the sidewall 68*b*, the link arms 71 being rotatable about a common axis of rotation that is perpendicular to the axis of rotation of the foot 67. The movement of the link arms 71 is controlled by an actuator (not shown). A gripping device 15 is rotatably attached to the outer end portions 71*a* of the link arms 71, which gripping device is arranged partially to enclose and hold the lower portion 2*a* of the drill string 5 or the drill pipe length 1.

Drill pipe lengths 1 are placed horizontally in the transit rack 3 at the drill floor 9 in a known manner. The pipes 1 are moved laterally one by one towards subsystem A, where they are gripped by the first gripping device 15*a* and the first means of lateral support 21*a*. The first primary carriage 13*a* and the first secondary carriage 19*a*, respectively, are displaced along the first and second guideways 17*a*, 17*b*, respectively, in synchronized motion until the drill pipe length 1 assumes a vertical position.

The tertiary carriage 23 has been moved to the lower end portion of the third guideway 17*c*.

Drill pipe lengths 1 are assembled to form drill string sections 5 consisting of three drill pipe lengths 1, in the following way:

a) A drill pipe length 1 is moved by use of means (not shown) associated with the first gripping device 15*a* and the first means of lateral support 21*a* for horizontal displacement of the drill pipe length 1, into subsystem B, the drill pipe length 1 being gripped by the clamping means 25 of the tertiary carriage 23 and released from the first gripping device 15*a*.

b) The tertiary carriage 23 is moved up along the third guideway 17*c*, lifting the drill pipe length 1 into engagement with the second means of lateral support 21*b* and the second gripping device 15*b*, the second secondary carriage 19*b* and the second primary carriage 13*b* being displaced along the third guideway 17*c* to a suitable position.

c) The drill pipe length 1 is held in a suitable position for joining with the next drill pipe length 1 by means of the second gripping device 15*b* and the second means of lateral support 21*b*, the second primary carriage 13*b* and the second secondary carriage 19*b* being displaced to a suitable position along the third guideway 17*c*.

d) After the clamping means 25 has been released from the drill pipe length 1 the tertiary carriage 23 is moved back to the lower end portion of the third guideway 17*c*.

Procedure a) is repeated for a second drill pipe length 1 and followed by:

e) The first drill pipe length 1 is lowered to be joined with the second drill pipe length 1, the second primary carriage 13*b* and the second secondary carriage 19*b* being displaced along the third guideway 17*c*, and the first drill pipe length 1 being rotated and screwed together with the second drill pipe length 1 by use of the means (not shown) of the second gripping device 15*b* for rotation of the drill pipe length 1.

Procedures b)-d) are then repeated for the incomplete drill string section 5 consisting of two joined drill pipe lengths 1.

Then a third drill pipe length 1 is joined to the incomplete drill string section 5 as described for the second drill pipe length, but without the tertiary carriage 23 displacing the third drill pipe length 1 up along the third guideway 17*c*.

The complete drill string section 5 is then transported from subsystem B to subsystem C by the third gripping device 15*c* and the third means of lateral support 21*c* holding and moving the drill string section 5, and also by synchronous movement of the third primary carriage 13*c* and the third secondary carriage 19*c* along the fourth and fifth guideways 17*d*, 17*e*, respectively.

The gripping tongs 31*b*, 33 of the pipe handlers 27, 29 are brought to receive the drill string section 5, whereupon the drill string section 5 is coupled to the drill string 7 in a manner that is known per se, or optionally transferred for further transport to its position in the finger boards 11*a*, 11*b*.

Transport of the drill string 5 between subsystem C and subsystem D is carried out as follows:

The drill string section 5 is transferred from engagement with the gripping tongs 31*b*, 33 of the pipe handlers 27, 29 to the fourth gripping device 15*d* and the fourth means of lateral support 21*d* by the gripping tongs 31*b*, 33 moving the drill string section 5 by horizontal rotation into the operating area of the fourth primary carriage 13*d* and the fourth secondary carriage 19*d*, whereupon the gripping device 15*d* and the means of lateral support 21*d* grip the drill string section and the carriages 13*d*, 19*d* are displaced along the sections 17*f*', 17*g*', or alternatively 17*f*", 17*g*", of the sixth and seventh guideways, respectively.

The shuttle carriages 47, which are interconnected with the fifth primary carriage 13*e* and the fifth secondary carriage 19*e*, respectively, are moved synchronously along the sections 17*f*', 17*g*', or alternatively 17*f*", 17*g*", of the sixth and the seventh guideways, respectively, to the finger 41*a*, 41*b*, respectively, at which the drill string section 5 is to be stored. With this, the shuttle carriages 47 form an extension of the finger 41*a*, 41*b*, where the fifth primary carriage 13*e* and the fifth secondary carriage 19*e*, respectively, after receiving the drill string section 5 and holding the drill string section 5 by means of the fifth gripping device 15*e* and the fifth means of lateral support 21*e*, respectively, are moved in synchronized motion along the extended fingers 41*a*, 41*b* to the chosen storage position in the finger boards 11*a*, 11*b*.

Upon reaching the chosen storage position, the drill string section 5 is released from the fifth primary carriage 13*e* and the fifth secondary carriage 19*e*, the drill string section 5 being lowered to abutment between its lower end portion 2*a* and the deck below (not shown) by the use of means (not shown) associated with the fifth primary carriage 13*e* for vertical displacement of the drill string section 5.

The stored drill string section 5 is then locked to at least the upper finger board 11*b* in a known manner, and the fifth primary carriage 13*e* and the fifth secondary carriage 19*e* are moved to the starting point at their separate shuttle carriages 47.

For i) retrieval of a drill string section 5 from the storage position in the finger boards 11*a*, 11*b*, ii) removal of a drill string section 5 from the drill string 7 or iii) dismantling of drill string sections into separate drill pipe lengths 1 and transfer of these to the transit rack 3, the above described procedures are reversed.

A primary carriage 13 having a hinged gripping device 15 of the type shown in FIGS. 9 and 10 is capable of moving the drill pipe length 1 or the drill string section 5 horizontally and vertically relative to the carriage 13, the gripping device 15 being movable in an arc through movement of the link arm 71 about their common horizontal axis of rotation. When the foot 67 rotates about its axis of rotation on the underbody 61 the gripping device 15 can retrieve or hand over the drill pipe length 1 or drill string section 5 inside a sector of about 180°.

During transport, the drill pipe length 1 or drill string section 5 is supported by the locating peg 69, thus relieving the gripping device 15.

A movable gripping device 15 of the above type may be used on all primary carriages 13*a-e* that require means of transferring the drill pipe length 1 or drill string section from one carriage to another without the use of external means, e.g. pipe handlers 27, 29. In the embodiment described, this applies to primary carriages 13*a*, 13*c* and 13*e*.

Advantageously the secondary carriages 19*a-e* are provided with means of lateral support 21*a-e* fixed to the secondary carriage in a way such that the means of lateral support 21*a-e* can move the upper end portion 2*b* drill pipe length 1 or drill string section 5 synchronously with the gripping device 15 moving the lower end portion 2*a* in the sector that is perpendicular to the central axis of the drill pipe length 1 or drill string section 5, as described above. Because the means of lateral support 21*a-e* allows the drill pipe length 1 or drill string section 5 to move axially relative to the secondary carriage 19*a-e*, the means of lateral support 21*a-e* does not need to show movement in the axial direction of the drill pipe length 1 or drill string section 5.

The laterally moveable means of lateral support 21*a-e* is used only on secondary carriages 19*a-e* cooperating with primary carriages 13*a-e* that display a movable gripping device 15 of the type shown in FIGS. 9 and 10.

The invention is not limited to the handling of drill string sections consisting of three drill pipe lengths but covers any size of drill string section. The invention also covers a combination of different lengths of drill string sections, as the device of the invention may comprise several fingerboards arranged over each other, with associated guideways, means of transport, gripping devices and means of lateral support, and also pipe handlers.

Moreover, the invention is not limited to the handling of drill pipes only, but also covers the handling of other types of pipes, such as liners and production tubing used in and at said exploration and production wells.

The invention claimed is:

1. A device for handling and storage of drill string sections, and assembly or disassembly of a drill string on an installation intended for drilling for hydrocarbons, the device comprising:

at least one set of individually travelling, separate but cooperating means of transport arranged to move in synchronized motion to move a drill string section or a single drill pipe length; wherein primary means of transport is provided with a first gripping device for releasably holding a lower end portion of the drill string section or drill pipe length;

secondary means of transport is provided with first means of lateral support for releasably enclosing an upper end portion of the drill string section or drill pipe length; and wherein every means of transport is displaceable along a substantially horizontal or vertical guideway.

2. A device in accordance with claim 1, wherein:

at least one of the primary means of transport is provided with means of joining and separating drill pipe lengths in the drill string section; and wherein at least one of the primary means of transport is provided with means of vertical displacement of the first gripping device.

3. A device in accordance with claim 1, wherein the device comprises an upper and a lower finger board for positioning of the upright drill string section in a storage area and holding of the drill string section in a chosen position, where the upper and lower fingerboards are separately provided with at least one set of transport means for substantially horizontal displacement of the drill string section along the guideways; and that the device comprises means positioned in close proximity to the upper and lower finger boards, respectively, for joining and separating the drill string section to/from the drill string.

4. A device in accordance with claim 3, wherein the device comprises:

means of moving a drill pipe length between a horizontal position and a vertical position;

means of joining and separating at least two upright drill pipe lengths associated with an upright drill string section, by rotating a drill pipe length about its central axis for joining or separation at the thread areas of the drill pipe length;

a lower pipe handler and an upper pipe handler located in close proximity to the extension of the wellbore axis of a drill floor; and means of transferring a drill pipe length or a drill string section between the means of moving a drill pipe length between a horizontal position and a vertical position and the means of joining and separating at least two upright drill pipe lengths associated with an upright drill string section; means of transferring a drill pipe length or a drill string section between the means of joining and separating at least two upright drill pipe lengths associated with an upright drill string section and the fingerboards; and means of transferring a drill pipe length or a drill string section between the fingerboards the lower pipe handler and the upper pipe handler.

5. A device in accordance with claim 4, wherein the lower pipe manipulator is provided with means for horizontal and vertical displacement of a lower and an upper pipe gripping tong.

6. A device in accordance with claim 5, wherein the lower pipe gripping tong is arranged to hold the drill string in a firm grip, and that the upper pipe gripping tong is arranged to rotate the drill string section about the central axis of the pipe to join or separate the drill section to/from the drill string.

7. A device in accordance with claim 1, wherein the device comprises means of moving a drill pipe length between a horizontal position and a vertical position, which means comprise:

the first gripping device mounted on a first primary means of transport arranged to move along a first guideway; and one of the first means of lateral support mounted on a first secondary means of transport arranged to move along a second guideway.

8. A device in accordance with claim 7, wherein the first guideway is substantially horizontal.

9. A device in accordance with claim 7, wherein the second guideway is substantially vertical.

10. A device in accordance with claim 1, comprising first, second and third guideways, wherein the third guideway comprises:

at least two vertically displaceable means of transport, each provided with a gripping device and/or means of lateral support for rotational joining and separation of the thread areas of the drill string section and vertical displacement of the assembled drill string section or the separate drill pipe length;

means of moving the upright drill pipe length out of engagement with the first gripping device and the first means of lateral support and into engagement with the gripping device and/or means of lateral support of the third guideway; and means of moving the upright drill string section into or out of engagement with upper and lower pipe handlers.

11. A device in accordance with claim 10, wherein the third guideway comprises:

an upper second secondary means of transport provided with a second means of lateral support for releasably enclosing an upper end portion of the drill string section or a first drill pipe length;

an intermediate second primary means of transport provided with a second gripping device for releasably holding a middle section of the drill string section or a lower end portion of the first or second drill pipe lengths;

a lower tertiary means of transport provided with clamping means for releasably holding a lower portion of the drill string section or the lower end portion of a drill pipe length; where the intermediate second primary means of transport and/or the lower tertiary means of transport is provided with means of rotating the drill string section or parts of the drill string section about the central axis of the pipe.

12. A device in accordance with claim 11, wherein one or more of the clamping means, the lower pipe handler and the gripping devices are provided with lifting means for vertical movement of the drill string section or drill pipe length.

13. A device in accordance with claim 11, wherein one or more of the clamping means, the lower and upper pipe handlers, the gripping devices and the means of lateral support are provided with means for horizontal movement of the drill string section or drill pipe length.

14. A device in accordance with claim 10, wherein the means of moving the drill string section into or out of engagement with the lower and upper pipe handlers comprise a fourth and a fifth guideway, respectively, a third primary means of transport provided with a third gripping device for releasably holding the lower end of the drill string section being movably coupled to the fourth guideway, and a third secondary means of transport provided with a third means of lateral support for releasably enclosing the upper end of the drill string section being movably coupled to the fifth guideway.

15. A device in accordance with claim 14, wherein the device comprises:

means of transport for horizontal displacement of a drill string section along sixth and a seventh guideway, respectively, in close proximity to a free finger end portions of the upper and lower fingerboards, respectively; and means of transport for horizontal displacement of a drill string section along the fingers of the upper and lower finger boards, respectively.

16. A device in accordance with claim 15, wherein the means of transport for horizontal displacement of a drill string section along the sixth and seventh guideways, respectively, comprise a fourth secondary means of transport with a fourth means of lateral support for releasably enclosing an upper end portion of a drill string section, and a fourth primary means of transport with a fourth gripping device for releasably holding the lower end portion of the drill string section, respectively.

17. A device in accordance with claim 15, wherein the means of transport for horizontal displacement of the drill string section along the fingers of the upper and lower finger boards, respectively, comprise a fifth secondary means of transport with a fifth means of lateral support for releasably enclosing the upper end portion of the drill string section, and a fifth primary means of transport with a fifth gripping device for releasably holding the lower end portion of the drill string section, respectively.

18. A device in accordance with claim 17, wherein the fifth primary means of transport and the fifth secondary means of transport, respectively, are separately provided with coupling means for releasable connection to a shuttle carriage.

19. A device in accordance with claim 18, wherein the shuttle carriage is arranged, after controlled release of the fifth secondary means of transport and the fifth primary means of transport, respectively, from movable interconnection with an arbitrary finger on the upper and lower finger boards, respectively, to bring a fifth secondary means of transport and the fifth primary means of transport, respectively, into engagement with another arbitrary finger in the upper and lower finger boards, respectively.

20. A device in accordance with claim 18, wherein the means of transport are carriages that engage driving means of the guideway or the shuttle carriage.

21. A device in accordance with claim 17, wherein at least one of the gripping devices is provided with means of providing fixed vertical support for the drill string section.

22. A device in accordance with claim 1, wherein the means of transport are provided with or connected to means of controlling movements of the means of transport.

23. A device in accordance with claim 1, wherein the device comprises means of monitoring the position of any drill string section in the system.

* * * * *